US008554092B2

(12) United States Patent
Tanaka

(10) Patent No.: US 8,554,092 B2
(45) Date of Patent: Oct. 8, 2013

(54) IMAGE FORMING APPARATUS CONTROLLING A TONER AMOUNT PER UNIT AREA OF A TRANSPARENT TONER IMAGE TO BE FORMED ON A RECORDING MATERIAL

(75) Inventor: Sumito Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 286 days.

(21) Appl. No.: 13/053,589

(22) Filed: Mar. 22, 2011

(65) Prior Publication Data

US 2011/0236045 A1 Sep. 29, 2011

(30) Foreign Application Priority Data

Mar. 29, 2010 (JP) ..... 2010-075437

(51) Int. Cl.
*G03G 15/00* (2006.01)

(52) U.S. Cl.
USPC ..... 399/45; 399/15; 399/53

(58) Field of Classification Search
USPC ..... 399/45, 53, 15, 38, 49, 341
See application file for complete search history.

(56) References Cited

U.S. PATENT DOCUMENTS

| | | | | |
|---|---|---|---|---|
| 7,764,894 | B2 | 7/2010 | Tanaka | |
| 8,086,124 | B2 | 12/2011 | Zaima | |
| 8,086,161 | B2 | 12/2011 | Omata | |
| 8,190,076 | B2 | 5/2012 | Omata | |
| 8,373,896 | B2 | 2/2013 | Tsutsumi | |
| 2004/0109160 | A1 | 6/2004 | Luxem et al. | |
| 2007/0127940 | A1 * | 6/2007 | Zaima | 399/53 |
| 2008/0298860 | A1 | 12/2008 | Omata | |
| 2009/0263148 | A1 | 10/2009 | Omata | |
| 2009/0296120 | A1 | 12/2009 | Tsutsumi | |
| 2010/0196023 | A1 * | 8/2010 | Shiozawa | 399/39 |
| 2011/0206395 | A1 * | 8/2011 | Tanaka et al. | 399/53 X |

FOREIGN PATENT DOCUMENTS

| | | | |
|---|---|---|---|
| CN | 1983059 | A | 6/2007 |
| CN | 101334603 | A | 12/2008 |
| CN | 101566812 | A | 10/2009 |
| CN | 101598913 | A | 12/2009 |
| JP | 9-200551 | | 7/1997 |

OTHER PUBLICATIONS

Chinese Office Action dated Mar. 21, 2013, issued in counterpart Chinese Application No. 201110076253.3, and English-language translation thereof.

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes an image forming portion for forming a toner image of color toner and transparent toner on a recording material; a heating device for heating the toner image formed on the recording material; an execution portion for executing a mode in which the transparent toner is partly placed in an image formable region of the recording material; and a control portion for controlling, on the basis of an amount of the color toner to be placed in an adjacent region adjacent to a region in which the transparent toner is to be placed, the amount of the transparent toner so that the amount of the transparent toner to be partly placed on the recording material when glossiness in the adjacent region is high is larger than that when the glossiness in the adjacent region is low.

8 Claims, 18 Drawing Sheets

(b)

(a)

IMAGE FORMING APPARATUS CONTROLLING A TONER AMOUNT PER UNIT AREA OF A TRANSPARENT TONER IMAGE TO BE FORMED ON A RECORDING MATERIAL

FIELD OF THE INVENTION AND RELATED ART

The present invention relates to an image forming apparatus, such as an electrophotographic copying machine, a printer, etc. In particular, the present invention relates to the image forming apparatus that fixes a toner image on a recording material using a combination of non-transparent (color) toner and transparent (clear) toner.

In recent years, for the purpose of further improving the added value of a print to be outputted by the electrophotographic image forming apparatus, a constitution for adjusting the glossiness of the print to be outputted by using a transparent toner has been proposed.

For example, Japanese Laid-Open Patent Application (JP-A) Hei 9-200551 discloses a constitution for adjusting the toner amount per unit area (hereinafter referred to as the toner amount) of the transparent toner, depending on the toner amount of the color toner on the recording material, in order to adjust the glossiness of an image on the recording material after heating and fixing.

However, in the image forming apparatus as described in JP-A Hei 9-200551 in which the toner on recording material is heated and fixed, the melted state of the transparent toner during heating varies, depending on the type of the recording material and the amount of the color toner. For that reason, there arose such a problem that the image on the recording material after heating was not able to provide the desired glossiness.

Further, in recent years, it has been desired that a mark, such as a corporate mark or a watermark, for preventing forgery, is added in the image (document). Further, there has recently been an increasing demand to make such a mark conspicuous, irrespective of the type of the image to be formed on the recording material.

As a method of making conspicuous a mark visually recognized by a glossiness difference, a method is known in which a glossiness difference is provided between a portion (region) where the transparent toner is placed and its periphery (a region amount to the region where the transparent toner is placed) is made conspicuous.

However, even when the glossiness in the region in which the transparent toner is placed is equal to the glossiness in its peripheral region, a study by the present inventor shows that the difference in glossiness perceived by a human when viewing an image (hereinafter referred to as glossiness-difference feeling) decreases as the absolute glossiness in the peripheral region increases.

SUMMARY OF THE INVENTION

The present invention has been accomplished in view of the above-described problem.

A principal object of the present invention is to provide an image forming apparatus capable of retaining a glossiness difference perceived by a human even when the glossiness of an output image is changed by using transparent toner.

According to an aspect of the present invention, there is provided an image forming apparatus comprising:

an image forming portion for forming a toner image of color toner and transparent toner on a recording material;

heating means for heating the toner image formed on the recording material;

execution means for executing a mode in which the transparent toner is partly placed in an image formable region of the recording material; and control means for controlling, on the basis of an amount of the color toner to be placed in an adjacent region adjacent to a region in which the transparent toner is to be placed, the amount of the transparent toner so that the amount of the transparent toner to be partly placed on the recording material when glossiness in the adjacent region is high, is larger than that when the glossiness in the adjacent region is low.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

General Structure of Image Forming Apparatus

Figure 1:
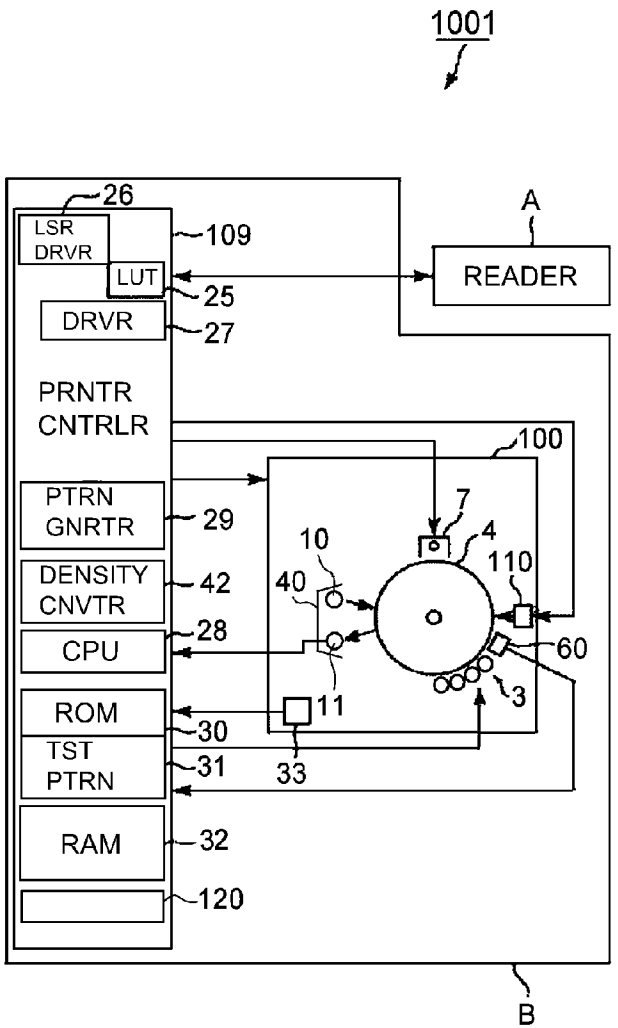
FIG. 1(*a*) is a schematic view showing a general constitution of an image forming apparatus in First Embodiment, and FIG. 1(*b*) is a schematic view showing an example of a constitution of a printer portion.
Figure 1:
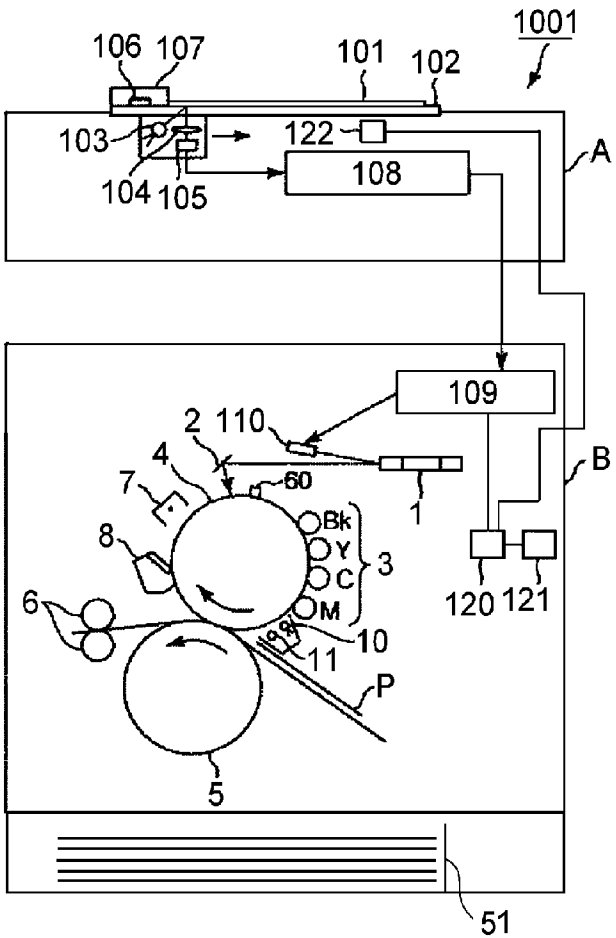

With reference to FIGS. 1(*a*) and 1(*b*), an image forming apparatus in a First Embodiment according to the present invention will be described. FIG. 1(*a*) is a schematic view showing a general structure of an image forming apparatus 1001 in this embodiment, and FIG. 1(*b*) is a schematic view showing an example of a constitution of a printer portion.

(Reader Portion)

An original 101 placed on an original supporting platen glass 102 is illuminated by a light source 103. The light reflected by the original 101 is focused on a CCD (image) sensor 105 (color toner image detecting means) via an optical system 104. The CCD sensor 105 consists of three line sensor groups of CCDs, which are a group for red, a group for green, and a group for blue, in which the CCDs are arranged in a straight line. The line sensor CCD groups for red, green, and blue generate associated color-component signals. The optical reading unit converts the image of the original 101 into sequential electrical signals for each line, as it is moved in the direction indicated by an arrow shown in FIG. 1(*a*).

On the original supporting platen glass 102, a positioning member 107 for preventing oblique placement of the original 101 by controlling one edge of the original 101 thereto and a reference white plate 106 for determining the white level of the CCD sensor 105 and for effecting shading correction of the CCD sensor 105 with respect to the thrust direction are provided.

The image signals obtained by the CCD sensor 105 are processed by a reader image-processing portion 108 and are sent to a printer portion B, in which the image signals are processed by a printer control portion 109.

Figure 2:
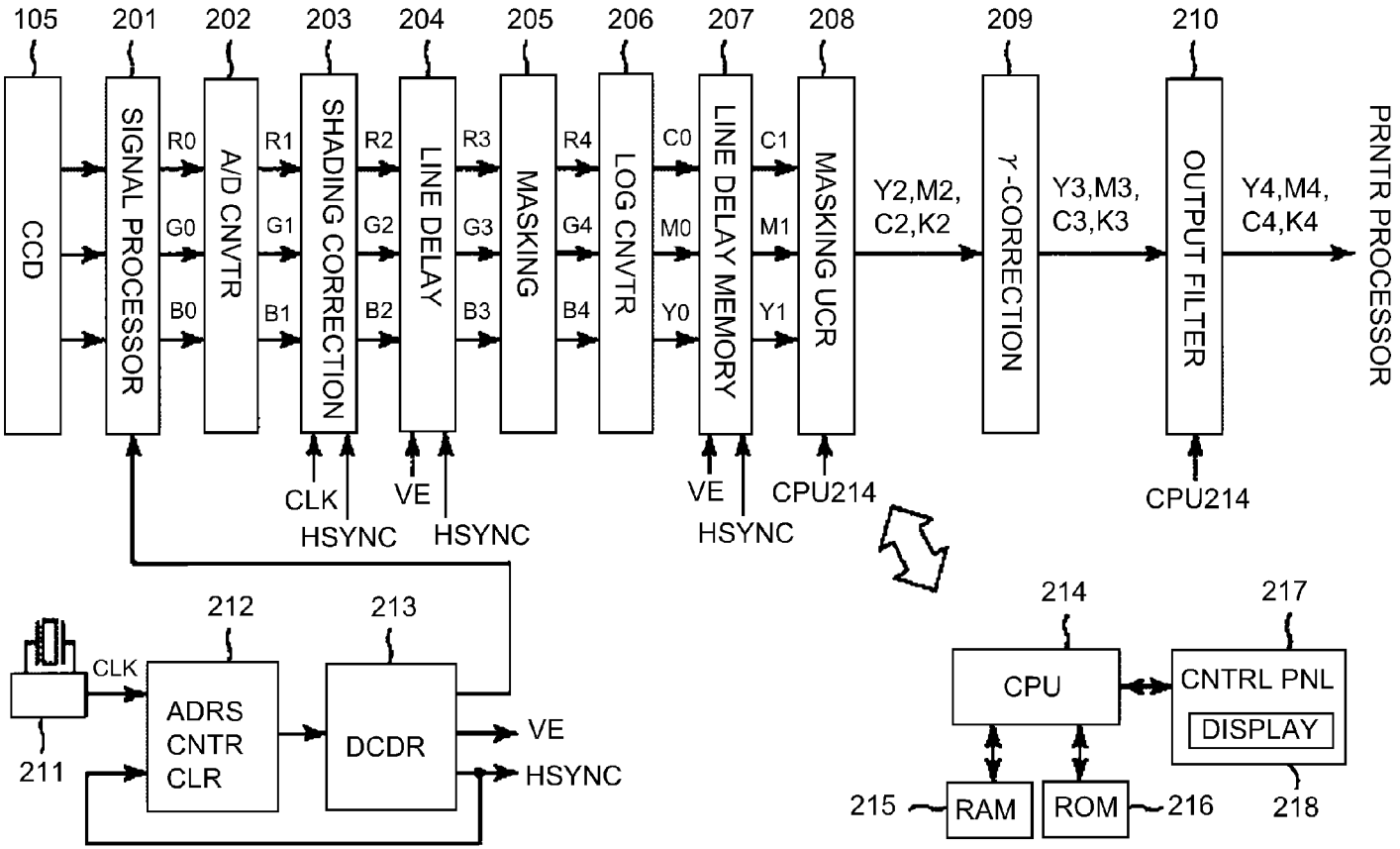
FIG. 2 is a block diagram showing flow of an image signal in a reader image-processing portion.

FIG. 2 is a block diagram showing flow of the image signals in the reader image-processing portion 108.

As shown in FIG. 2, the image signals outputted from the CCD sensor 105 are inputted into an analog signal-processing circuit 201, in which they are adjusted in gain and offset (R0, G0, B0). Then, they are converted into digital eight-bit image signals R1, G1 and B1 by an A/D converter circuit 202. The image signals R1, G1 and B1 are inputted into a shading correction circuit 203, in which they are subjected to a known shading correction by using the signals obtained by reading the reference white plate 106 for each color (R2, G2, B2).

A clock generation portion 211 generates a clock signal CLK per (one) pixel unit. An address counter 212 counts clock signals CLK, and generates and outputs a main-scan address signal per (one) line. A decoder 213 decodes the main-scan address signal to generate CCD drive signals, VE signals, and line synchronization signals HSYNC, per line. The CCD drive signals are signals such as a shift pulse, a reset pulses, etc. The VE signal indicates an effective range for each line, in the read signal outputted by the CCD sensor 105. Incidentally, the address counter 212 is cleared by the line synchronization signal HSYNC, and then, begins counting the main-scan address signals for the next line.

The respective line sensors of the CCD sensor 105 are aligned in the sub-scan direction with preset intervals. Therefore, the spatial deviation in the sub-scan direction is corrected by a line delay (portion) 204. More specifically, the line delay (portion) 204 line-delays the R and G signals relative to the B signal to align the RGB signal in terms of spatial position (R3, G3, B3).

An input masking circuit 205 converts the color space (space of a read color) of each of the inputted picture signals, which is determined by spectral characteristic of the RGB filters of the CCD sensor 105, into predetermined color spaces (e.g., standard color space, such as, sRGB, NTSC, etc.), using matrix computing.

A LOG conversion circuit 206 is constituted by ROMs containing look-up tables, and converts the luminance signals R4, G4 and B4 into density signals C0, M0 and Y0. A line delay memory 207 delays the density signals C0, M0 and Y0 by a length of time equal to the length of time necessary for determining signals, such as UCR, FILTER, SEN, etc., to be generated and outputted by an unshown black-character determining portion.

A masking UCR circuit 208 extracts black (Bk) signals from the three primary color signals Y1, M1 and C1 inputted into the masking UCR circuit 208. It also carries out the computation for correcting the turbidity of colorants, for the printer portion B and sequentially outputs image signals Y2, M2, C2 or Bk2 for every reading operation, with a preset bit width (eight bit, for example). A gamma correction circuit 209 corrects the image signals in terms of density, in order to adjust the printer section B to achieve the ideal gradation (Y3, M3, C3, K3). An output filter 210 subjects the image signals to edge enhancement and smoothing.

Image signals M4, C4, Y4 and Bk4 obtained by these processes are sent to the printer control portion 109, in which they are converted into pulse signals that are subjected to pulse-width modulation. Then, the printer portion B effects density recording.

A CPU 214 uses RAM 215 as a work memory to control the reader portion A and to effect image processing according to the programs stored in ROM 216. An operator inputs operational instructions and processing conditions into the CPU 214 through a control portion 217. A display device 218 displays an operation state of the image forming apparatus, set processing conditions, etc.

(Printer Portion)

At the image forming portion for forming the toner image in the printer portion B shown in FIGS. 1(*a*) and 1(*b*), the surface of a photosensitive drum 4 rotating in the direction indicated by an arrow is uniformly charged by a primary charger 7. The printer control portion 109 outputs pulse signals in accordance with the image data inputted by a laser driver. A laser light source 110 outputs a beam of laser light depending on inputted pulse signals. The beam of laser light is reflected by a polygon mirror 1 and a mirror 2, scanning thereby the surface of the charged photosensitive drum 4. An electrostatic latent image is formed on the surface of the photosensitive drum 4 by the laser light scanning.

The electrostatic latent image formed on the surface of the photosensitive drum 4 is developed by a developing device 3 with associated color toner for each color. In this embodiment, two-component toners are used and the four developing devices 3 for black Bk, yellow Y, cyan C, and magenta M are disposed in this order around the photosensitive drum 4 from the upstream side. The developing device corresponding to image-formation color approaches the photosensitive drum 4 to develop the electrostatic latent image.

A recording material P is wound around a transfer drum 5, which rotates one full turn for each of the respective color components, rotating therefore a total of four full turns. As a result, the respective color-toner images are transferred and superposed on the recording material P. After the transfer, the recording material P is separated from the transfer drum 5, and is sent to a fixation roller pair 6 (heating portion), by which the toner (toner images) on the recording material P is fixed, so that a full-color print is completed.

Further, at the periphery of the photosensitive drum 4, a surface potential sensor 60 for measuring the surface potential of the photosensitive drum 4, and a cleaner 8 for removing untransferred residual toner on the photosensitive drum 4 are provided on the upstream side of the developing devices 3 (the arrow head side shown in FIG. 1(*a*) is the downstream side). An LED light source 10 and a photo-diode 11, which are for detecting the amount of the light reflected by a toner patch formed on the photosensitive drum 4, are disposed in the apparatus.

FIG. 1(*a*) is a block diagram showing an example of the constitution of the printer portion B.

The printer control portion 109 is constituted by a CPU (central processing unit) 28, ROM (read only memory) 30, RAM (random access memory) 32, a test pattern storage portion 31, a density conversion circuit 42, a LUT (look-up table) 25, a laser driver 26, a driver 27, a pattern generator 29, etc. Further, the printer control portion 109 is communicatable with the reader portion A and the printer portion B. The CPU 28 controls the operation of the printer portion B and controls the grid potential of the primary charger 7 and the developing bias of the developing device 3. The CPU 28 as a control means controls the respective portions of the image forming apparatus in accordance with programs stored in the ROM or the like.

The printer engine 100 of the printer portion B is constituted by the photosensitive drum 4, and the components disposed in the adjacencies thereof, such as, a photosensor 40 consisting of the LED 10 and photo-diode 11, the primary charger 7, the laser light source 110, the surface potential sensor 60 and the developing device 3. The printer engine 100 further includes an environment sensor 33 for measuring the content of moisture in the air (or temperature and humidity) in the apparatus.

(Structure of Image Forming Apparatus)

Figure 3:
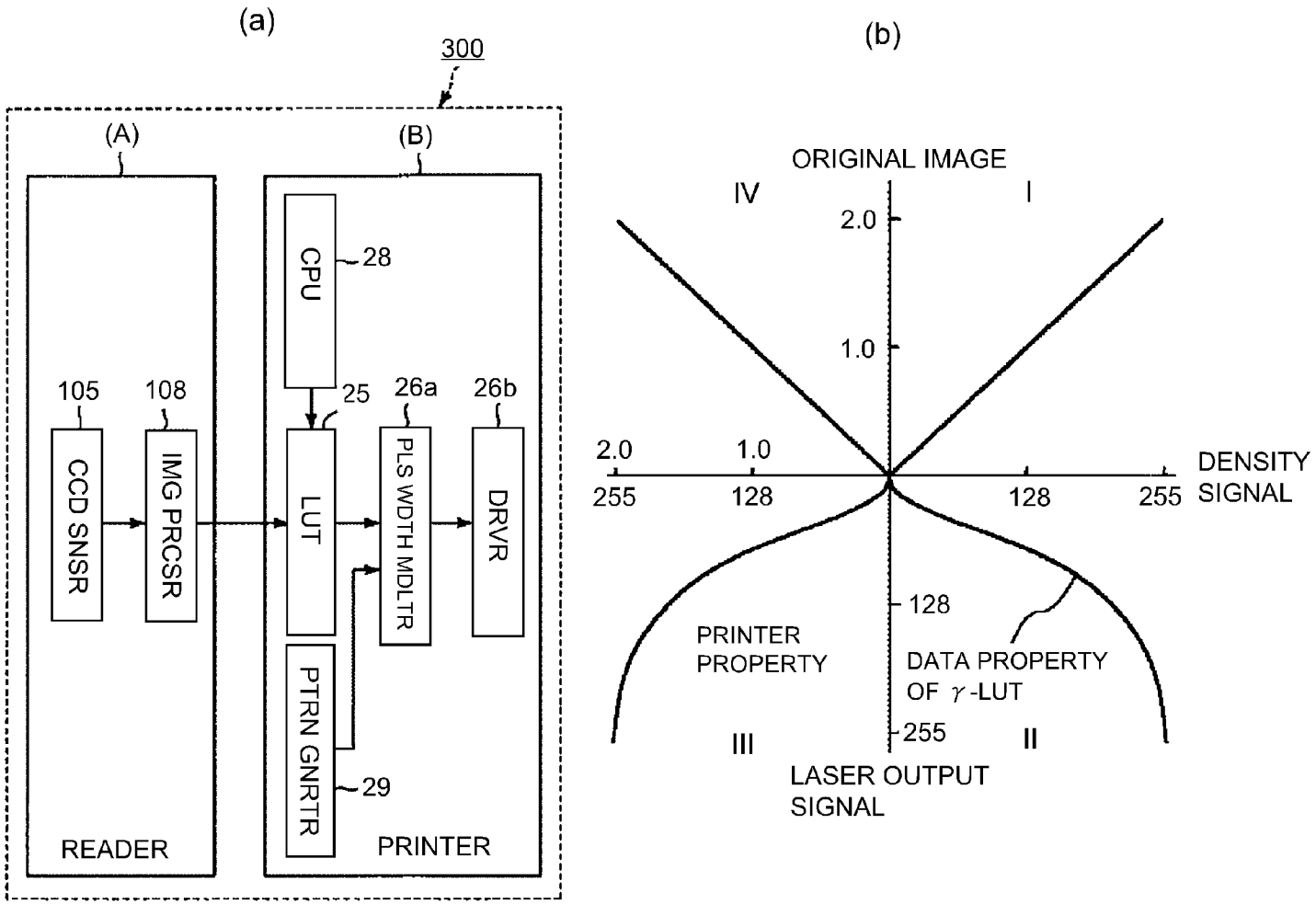
FIG. 3(*a*) is a block diagram showing an example of a constitution of an image processing device, and FIG. 3(*b*) is a quadrant graph showing a state in which gradation is reproduced.

FIG. 3(*a*) is a block diagram showing an example of a constitution of an image processing device 300 (color-toner amount controlling means) for obtaining a gradation image.

The luminance signals for images, which are obtained by the CCD sensor 105, are frame-sequentially converted by the reader image-processing portion 108 into density signals. The converted density signals are corrected by the LUT 25 (γLUT) in γ characteristic so that they match the gamma characteristic of the printer at the time of initial setting, that is, so that the original image and the output image match in density.

FIG. 3(*b*) is a quadrant chart (graph) which shows a state in which the gradation is reproduced. The first quadrant shows a reading characteristic of the reader portion A, which converts the density of the original into density signals, and the second quadrant shows a conversion characteristic of the LUT 25 for converting the density signals into laser output signals. The third quadrant shows a recording characteristic of the printer portion B, which converts the laser output signals into the density of the output image, and the fourth quadrant shows a relationship between the density of the original image and the density of the output image. FIG. 3(*b*) shows an overall gradation reproduction characteristic of the image forming apparatus 1001 shown in FIG. 1. Incidentally, since the image signals are processed by the digital eight-bit signals, FIG. 3(*b*) shows the case where the number of gradation levels is 256 (gradation levels).

In order to make linear the overall density gradation characteristic of the image processing device 300 (color-toner-amount controlling means) 300, that is, in order to make linear the gradation characteristic shown in the fourth quadrant, the density signals are corrected by the LUT 25 shown in the second quadrant to compensate for the printer characteristic shown in the third quadrant. The image signals which are converted with respect to the gradation characteristic are converted by a pulse-width-modulation (PWM) circuit 26*a* of the laser driver 26 into pulse signals corresponding to dot widths and then are sent to a laser driver (LD) 26*b* for controlling turning on/off of the laser light source 110. Incidentally, in this embodiment, the gradations for all the colors Y, M, C and Bk are reproduced using the pulse-width modulation.

Then, on the photosensitive drum 4, which is scanned by the beam of laser light outputted from the laser light source 110, the electrostatic latent image, having a predetermined gradation characteristic, the gradation level of which is controlled by changing the dot area (size), is formed. Through the above-described processes of developing, transfer, and fixing, the gradation image is reproduced.

[First Control System]

Next, a first control system regarding stabilization, in terms of the image reproduction characteristic, of the system including both the reader portion A and the printer portion B will be described as image control in a sequence different from that for the normal image formation for forming the image on the recording material.

As the control effected by this control system, there are control for performing calibration of the printer portion B by using the reader portion A and control for obtaining the grid potential and the developing-bias potential from the contrast potential. Then, control for setting a maximum density at a value higher than a final target value is performed, but the details thereof will be omitted from the description.

Figure 4:
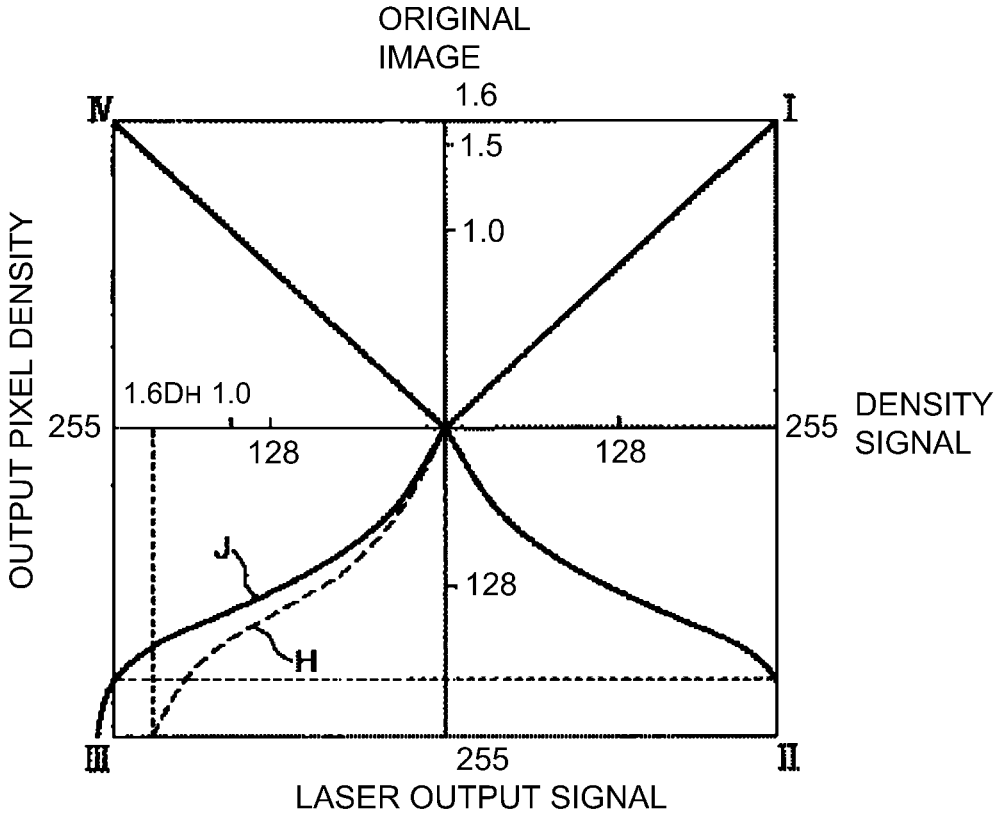
FIG. 4 is a quadrant graph showing a density-conversion property after control.

FIG. 4 is a graph showing a density-conversion characteristic after the above control. In this embodiment, by the control for setting the maximum density at the value higher than the final target value, the printer characteristic in the third (III) quadrant becomes as indicated by a solid line J. If the above-described control were not carried out, there is a possibility that the printer characteristic becomes as indicated by a broken line H such that the maximum density does not reach 1.6. In the case where the printer characteristic is as indicated by the broken line H, the maximum density cannot be raised by the LUT 25 and therefore, the density in the range between the density DH and 1.6 cannot be reproduced no matter how the LUT 25 is set. When the printer characteristic is such that the maximum density slightly exceeds 1.6 as indicated by the solid line J, the density-reproduction range is ensured by the correction based on the LUT 25, as shown by the total gradation characteristic shown in fourth (IV) quadrant.

When the contrast potential control by the first control system and the preparation of the gamma-conversion table are completed, display to the effect that automatic gradation correction is ended appears on the display device 218. The method described above is applicable to both of the transparent toner and the color toner.

The method for controlling glossiness of the output image of the image forming apparatus 1001 will be described.

The procedure for determining the amount of the transparent toner by a glossiness-control portion 120 (FIG. 1(*a*) and FIG. 1(*b*): transparent-toner-amount control means) will be described.

In this embodiment, the glossiness-control portion 120 effects feedback control such that it determines the glossiness of an outputted sample image of the above-described test patterns, and determines the amount of the transparent toner with respect to the output signal for each of the single-color toners.

The control of the transparent-toner amount is effected to control the glossiness difference of the output image and in this embodiment is effected for the purpose of obtaining the same glossiness-difference feeling in the outputted sample image, i.e., for the purpose of retaining the glossiness-difference feeling between the toner image, which is intended to be made conspicuous, and the background adjacent to the toner image. Incidentally, a difference in glossiness measured by a glossiness sensor between a portion at which the transparent toner (image) is fixed and a periphery of the portion is referred to as absolute glossiness difference, and a difference felt by the human is referred to as the glossiness-difference feeling (subjective glossiness difference).

In order to verify the difference between the absolute glossiness difference and the subjective glossiness difference (glossiness-difference feeling), the following sample image was prepared, and a subjective test was conducted with respect to a test subject (tested). First, the sample image will be described. The sample image was prepared by forming an image with the color toner in a region of 5×5 mm on the recording material to form the ground portion (base portion). The base portion had glossiness values of 5, 20 and 40 by changing the amount of the color toner placed (formed) on the base portion.

Then, at a part (a central region of 2×2 mm in this embodiment) of the image of the base portion at which the glossiness (value) was 5, the transparent toner was placed to form a portion such that the glossiness in the region in which the transparent toner was placed was 15. That is, the sample image, including the transparent toner-placed region (mark portion) and the region (base portion) adjacent to the transparent toner-placed region between which the absolute glossiness difference was 10, was prepared.

In a similar manner, a plurality of sample images were prepared by partly placing the transparent toner on the image with the glossiness of 20 at the base portion and on the image with the glossiness of 40 at the base portion. By using the thus-prepared sample images, the test subject underwent the subjective test with respect to the glossiness difference at the base portion.

Figure 5:
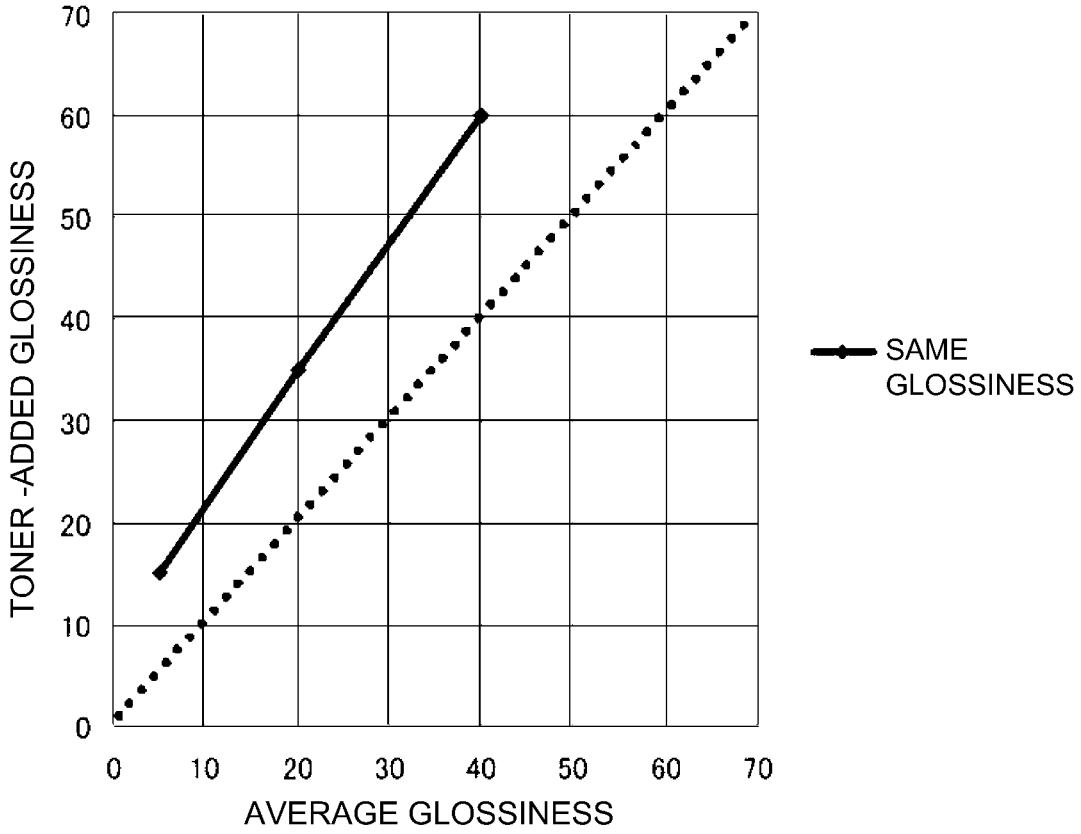
FIG. 5 is a graph showing a subjective evaluation result of glossiness that is felt as being the same (glossiness).

FIG. 5 is a graph showing a subjective evaluation result of the glossiness difference that is felt by the test subject as being the same. The subjective evaluation was made by causing the test subject to observe the sample images, prepared to have several different glossiness values, and to compare the ground portion (base portion) formed with the color toner and the mark portion formed with the transparent toner at the central portion of the base portion, to thereby check the glossiness-difference feeling.

As is understood from the result shown in FIG. 5, even in the case where the glossiness difference controlled in term of an absolute value is maintained, the glossiness difference felt by the human (i.e., the test subject) (glossiness-difference feeling) is changed when the glossiness at the base portion (hereinafter referred to as base glossiness) is changed. Incidentally, the glossiness in the region adjacent to the transparent toner-placed region, of the glossiness of the base portion, is important for a human to recognize the mark on the basis of the glossiness difference.

For example, when the glossiness difference between the glossiness values 30 and 40 is 10, the glossiness difference in terms of the absolute value is 10. When the glossiness values of the two sample images are increased while keeping this glossiness difference, as shown in FIG. 5, it is understood that the test subject gradually does not feel the glossiness difference. In other words, unless the glossiness difference in terms of the absolute value is increased with an increasing value of the glossiness, the glossiness-difference feeling perceived by a human is not constant.

In this embodiment, attention is focused on this fact, and control is effected such that the glossiness-difference feeling perceived by a human is kept constant by changing the glossiness difference in terms of the absolute value corresponding to the base glossiness.

As a result, the glossiness of the corporate mark or the glossiness at the part at the image is increased, so that it is possible to reflect the intention to make the mark or the part conspicuous. Even in the case where the glossiness difference in terms of the absolute value is made constant, when the base glossiness is increased, the portion that has been partly increased in glossiness for the purpose of making the portion conspicuous becomes inconspicuous, but according to this embodiment, this decrease in perceived glossiness can be obviated. This is because the control of the transparent-toner amount is effected so that the glossiness-difference feeling at a portion of the output image designated by a user and that at another portion of the output image designated by the user can be the same.

Figure 6:
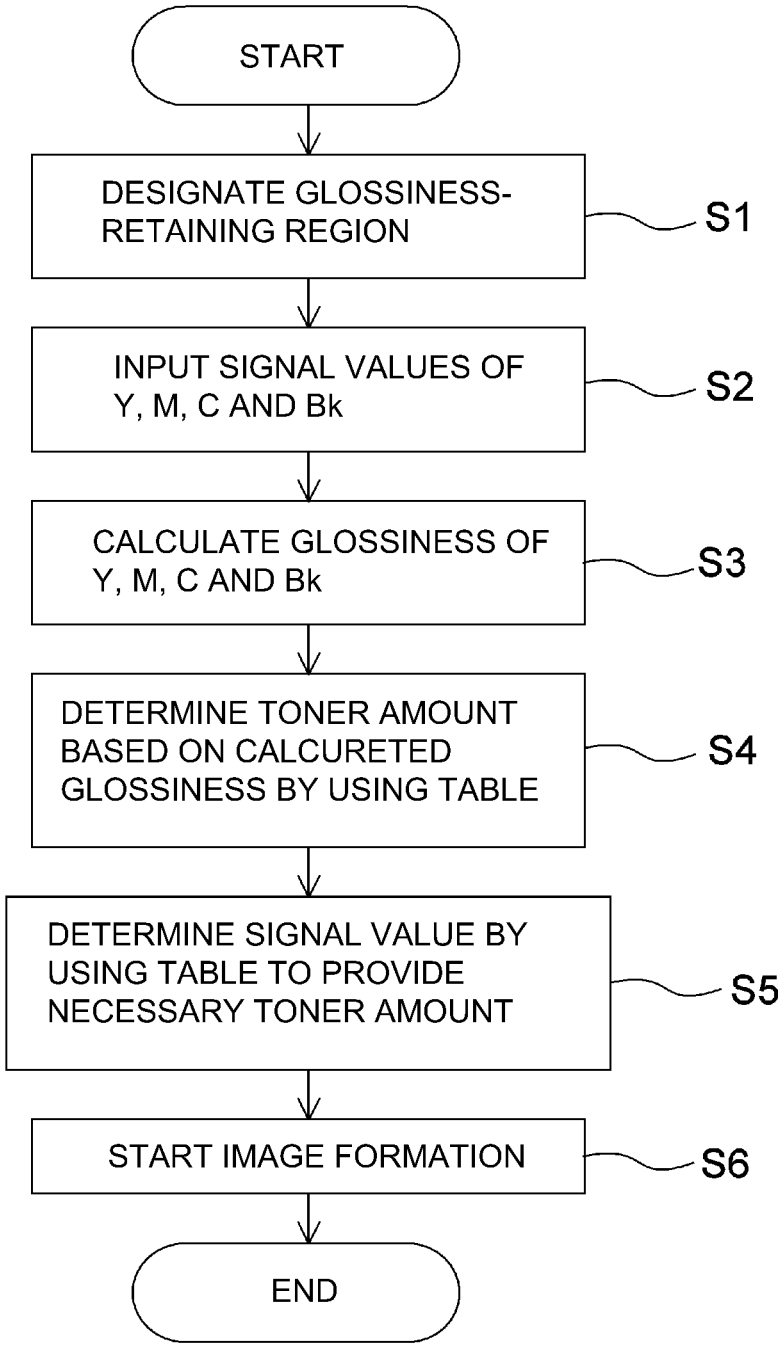
FIG. 6 is a flow chart of control in First Embodiment.

The steps in this embodiment are as shown in FIG. 6. FIG. 6 is a flow chart of the control in First Embodiment.

Incidentally, the term "average glossiness (average of glossiness values)" is used, but is not limited to one required to measure the glossiness at a plurality of points. That is, on the basis of the measurement at one point, the glossiness at the point may also be used as the average glossiness. In the case where the glossiness is measured (estimated) at only one point in the region, a measured value (representation value) of the glossiness at one point is referred to as an average value.

First, the user designates a region in which the glossiness-difference feeling is intended to be substantially the same irrespective of the glossiness of the base portion (S1). In this embodiment, a designation method is determined in a stage in which is designated a region in which the transparent toner is added. That is, in an image-processing software, in addition to a layer in which the color toner image is formed, a transparent toner layer (e.g., α layer) is prepared. In that layer, a region is designated in which the transparent toner image is formed. For example, when the transparent toner layer is placed so as to overlap with a yellow layer, the yellow portion can be made conspicuous due to the glossiness-difference feeling even in the case where the average glossiness varies depending on the toner amount (per unit area).

In this embodiment, an image-processing input portion capable of receiving the α layer as described above is provided. In this layer, signal input and positional information of an ordinary transparent toner image are also included. A multi-value image signal for the transparent toner in this mode may be transferred to a made determined by the glossiness of the image to be outputted by providing a user mode or the like comprising a glossiness-difference constant mode.

As a result, the region in which the transparent toner image is formed is designated, so that the glossiness-difference feeling can be kept constant between this region and a transparent toner-image formation region, described later, designated on the basis of the average glossiness of the output image estimated by an image-signal value for the color toner.

As for the image-output-control-signal level, the value for the maximum density of the image forming apparatus in this embodiment was set at 255 (level). Therefore, the image forming apparatus in this embodiment uses eight-bit gradation levels from 0 to 255 for each color toner (inclusive of transparent toner). Further, the grid potential and the developing-bias potential, which are used for preparing the transparent toner image, are determined in the following manner. That is, they are determined based on a relationship between the absolute water (moisture) content and the contrasts potential that are stored in advance in a table, and based on the output of the environment sensor 33. The grid potential and the developing-bias potential are determined by using the above-described potential-measurement control.

The image-signal values for the color toners are inputted (S2).

Next, from the image-signal values for the color toners, which are inputted on a pixel unit basis, the glossiness values per pixel unit are obtained and averaged, so that an average glossiness of the output image is determined (S3).

In order to obtain the glossiness on an image-unit basis, a relationship between the image signal and the glossiness is used. The number of the colors of the color toners is four and therefore the maximum image-signal value is 255×4=1020. In the color image forming apparatus, the toner amount is restricted in order to prevent winding of the recording material about a fixing member. In the normal image forming apparatus, a toner amount limitation is made, so that the image-signal value is suppressed to the level for 2.4 colors, i.e., about 255×2.4=612. Also in this embodiment, the image-signal value to be inputted into one pixel is 612 at the maximum. Specifically, the toner amount for 4 colors is suppressed to the toner amount for about 2.4 colors by performing processing which is called UCR (under color removal). The UCR is a method in which the toner amount is suppressed by replacing the toners of yellow, magenta and cyan with the black toner.

Figure 7:
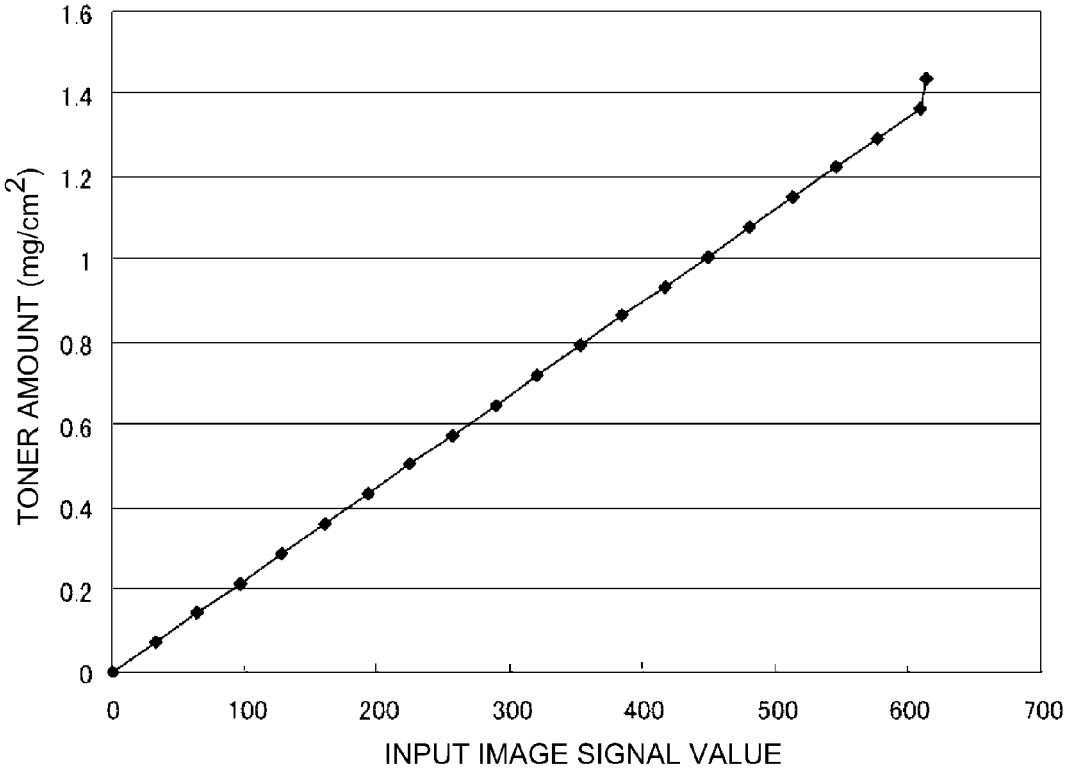
FIG. 7 is a graph showing a recording material an image-signal value and a toner amount.
Figure 8:
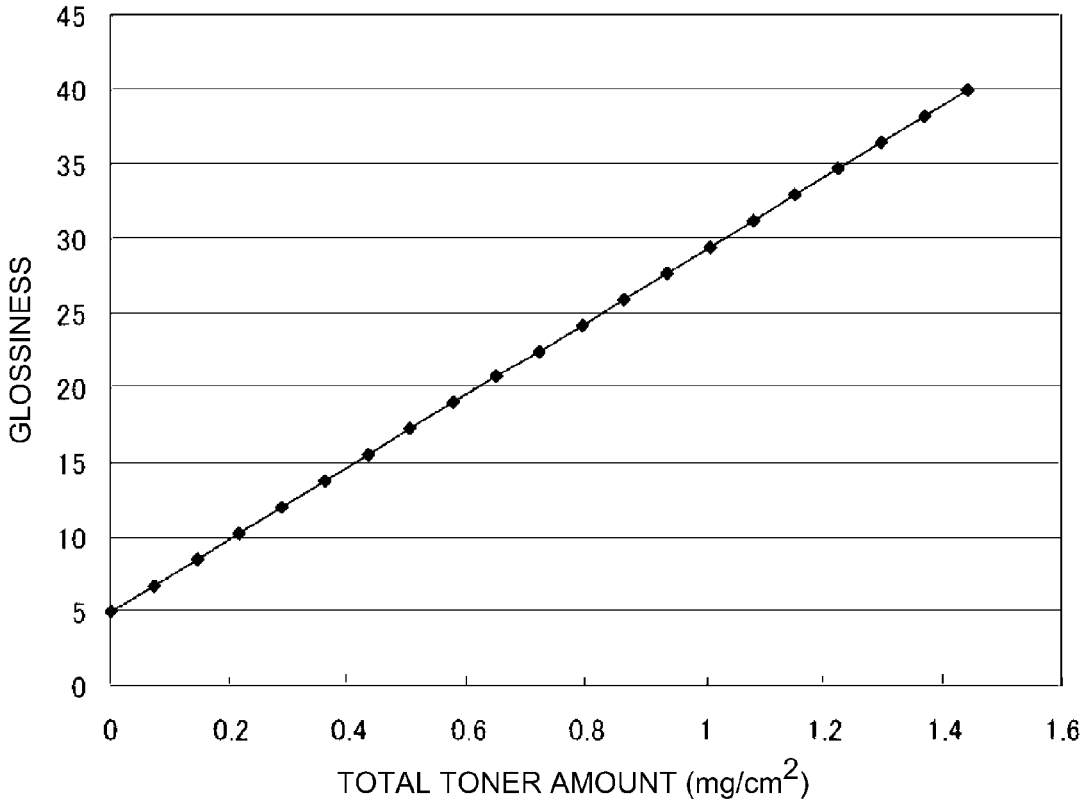
FIG. 8 is a graph showing a relationship between the toner amount and the glossiness.

FIG. 7 is a graph showing the relationship between the image-signal value and the toner amount. FIG. 8 is a graph showing the relationship between the toner amount and the glossiness.

The color toners provide little difference in glossiness. That is, the glossiness at a portion where the yellow toner is placed in the toner amount of 1 mg/cm$^2$ is substantially equal to the glossiness at a portion where the magenta toner is placed in the same toner amount (1 mg/cm$^2$). For that reason, in this embodiment, the glossiness of the image to be outputted is determined (estimated) on the basis of the image-signal value.

Specifically, the glossiness of the image to be outputted is calculated by using the relationship between the image-signal value and the toner amount as shown in FIG. 7 and the relationship between the toner amount and the glossiness as shown in FIG. 8. More specifically, by using the LUT 25, the toner amounts of the respective color toners required to output a desired color image is calculated. Then, from the toner amount, per pixel unit, calculated by the LUT, the glossiness per each pixel unit is obtained by making reference to the relationship between the toner amount and the glossiness shown in FIG. 8. From the above result, the glossiness values at the respective pixel units are obtained and averaged, so that the average glossiness of the output image is obtained.

Figure 9:
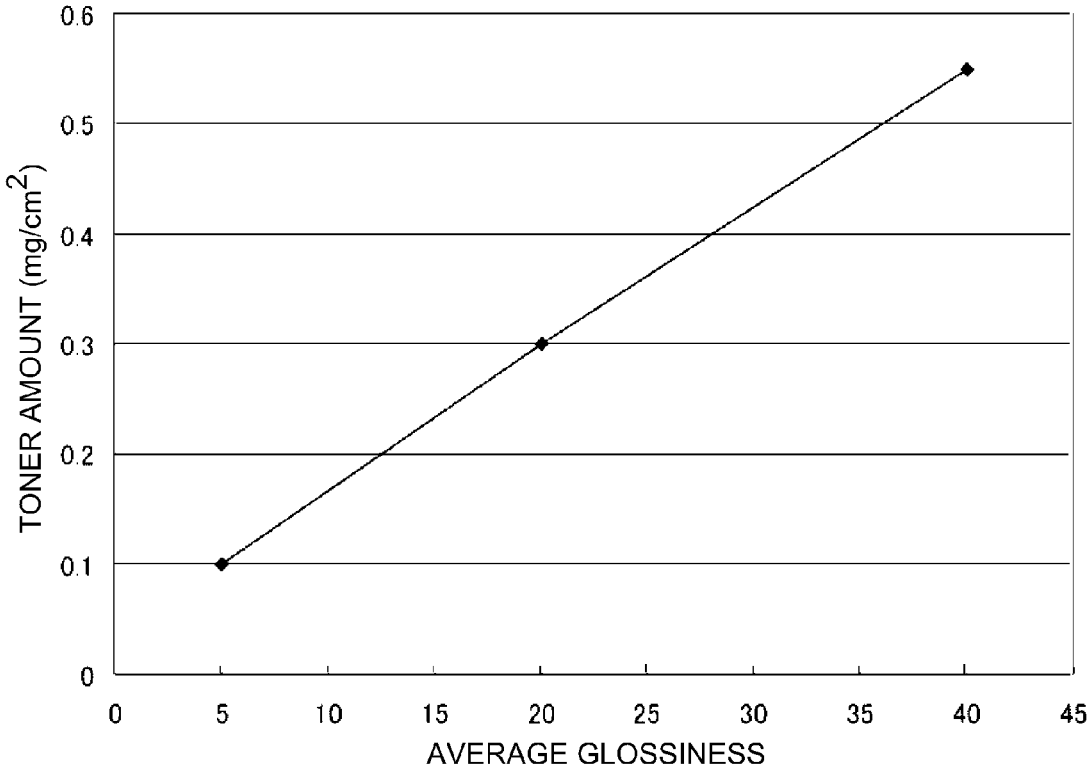
FIG. 9 is a graph showing a relationship between an average glossiness and a transparent-toner amount.

After the average glossiness is obtained, the transparent-toner amount in the designated region is determined (S4). The transparent-toner amount is obtained by making reference to an average glossiness-transparent-toner-amount table as shown in FIG. 9. FIG. 9 is a graph showing the relationship between the average glossiness and the transparent-toner amount. In this table (FIG. 9), the transparent-toner amount necessary to provide the same glossiness-difference feeling depends on the base glossiness. As is apparent from FIG. 9, the transparent-toner amount is controlled so that the amount of the transparent toner per unit area to be placed in the case where the average glossiness obtained from the inputted color image is high is larger than that placed in the case where the average glossiness is low. As a result, irrespective of the inputted color image, it is possible to make constant the difference in glossiness perceived by a human.

When the transparent-toner amount is determined, the image-signal value for the transparent toner to be used for adding the toner amount is determined (S5). This image-signal value is determined by the LUT 25 for the transparent toner described above.

Incidentally, depending on the type of the recording material on which the color toner image is fixed, the glossiness in the case where the color toner in the same amount is used for the fixation also varies. For that reason, a constitution in which the CPU obtains the type (e.g., thick paper, coated paper, etc.) of the sheet (recording material) on which the image is to be formed and then changes the LUT 25 depending on the obtained type of the recording material may preferably be employed. That is, depending on the type of the recording material on which the toner image is to be formed, the toner amount and the glossiness are corrected. Specifically, a detecting means (e.g., a media sensor or the like) for detecting the recording material on which the toner image is to be formed is provided and depending on a detection result of the detecting means, the LUT corresponding to the type of the detected recording material is selected from a plurality of LUTs stored in the ROM.

When the above operations are completed, image formation for making the glossiness-difference feeling constant is effected (S6).

Incidentally, the mode in which the glossiness-difference feeling is made constant may also be provided so as to be switched from the image-forming mode using the normal transparent toner. That is, it is also possible to employ a constitution in which the user can select the mode from a normal image-forming mode in which the transparent toner image is formed with the transparent toner as a fifth toner in addition to the first to fourth toners of C, M, Y and Bk, and a glossiness-difference-feeling constant mode in which the transparent toner is added in order to keep the subjective glossiness difference constant. In the normal image-forming mode, the grid potential and the developing-bias potential for forming the transparent toner image are determined in the following manner.

For example, these potentials are determined on the basis of the relationship between the absolute water content and the contrast potential, which is stored in the table in advance, and the output of the environment sensor 33. By the potential-measurement control described above, the grid potential and the developing-bias potential are determined, and the image-signal value is determined by γLUT.

Further, as a normal image-forming mode 2, a mode in which the transparent toner image is formed by an inversion signal of either one of the image signals for Y, M, C and Bk may also be used for switching the image-forming mode. That is, it is also possible to use a method in which the transparent toner image is formed in the entire image region by using, as the image signal for the transparent toner, the image signal obtained by subtracting the image-signal value of the color toner in the entire image pixel from the image-signal value for the maximum toner amount, e.g., the image-signal value for the 2.4 colors, i.e., 255×2.4=612. Specifically, in the case where the color toner image-signal values at a certain pixel are 60 for cyan and 80 for magenta, the sum of the image-signal values is 140. Accordingly, the image-signal value for the transparent toner is calculated in the following manner.

First, the sum is subtracted from the image-signal value indicating the maximum toner amount as represented by: 612−140=472.

Then, the resultant value is divided by 2.4 colors as represented by: 472/2.4=196.

The thus-calculated value of 196 is the image-signal value for the transparent toner. This calculation is effected for every pixel to obtain the image-signal values for the transparent toner in the entire output image, so that the transparent toner image is formed.

Here, as is also apparent from FIG. 9, the amount of the transparent toner used for forming the transparent toner image is changed so that the amount transparent toner (0.55 mg/cm$^2$) in the case where the average glossiness obtained from the color-toner amount is 40 (First average glossiness) is larger than the transparent-toner amount (0.1 mg/cm$^2$) in the case where the average glossiness is 5 (second average glossiness). Here, the base portion refers to a region adjacent to the region in which the mark is formed by placing the transparent toner.

Therefore, it is more suitable that the following three modes:

1. the mode in which the subjective glossiness difference is kept constant as in the present invention,
2. the mode in which the transparent toner is added in the entire image region, and
3. the mode in which the transparent toner is added at an arbitrary portion irrespective of the color of the color toners, are selectable.

Incidentally, during the calculation of the average glossiness, it is also possible to use a weighed average of the glossiness values at a plurality of points. Specifically, when the corporate mark or the like is represented by the glossiness difference, viewability of the mark is improved by increasing the difference between the glossiness at an edge portion in the region that is intended to be made conspicuous and the glossiness in the region (in the neighborhood of the boundary) adjacent to the region to be made conspicuous. For that reason, the glossiness difference may preferably be made large at the boundary between the region to be made conspicuous and its adjacent region. In view of these factors, the weight average such that the weight is assigned to the glossiness in the neighborhood of the boundary may also be used. In this way, in view of the glossiness at the base portion (the region adjacent to the mark portion) obtained from the color-toner amount, by placing the transparent toner so that the absolute glossiness difference when the glossiness at the base portion is high is larger than that when the glossiness at the ground (base portion) is low, the subjective glossiness difference can be kept substantially constant. Incidentally, in this embodiment, the constitution in which the glossiness at the base portion obtained from the color-toner amount is added is described but the subjective glossiness difference may also be kept substantially constant by adding the glossiness, at the base portion, which varies depending on the difference in type of the recording material. That is, the glossiness at the portion where the toner image is not fixed is the glossiness intrinsic to the paper. For that reason, it is also possible to control the transparent-toner amount so that the absolute glossiness difference in the case where the glossiness of the paper (the glossiness on the background) is high is larger than that in the case where the glossiness of the paper (the glossiness on the background) is low.

Second Embodiment

Figure 10:
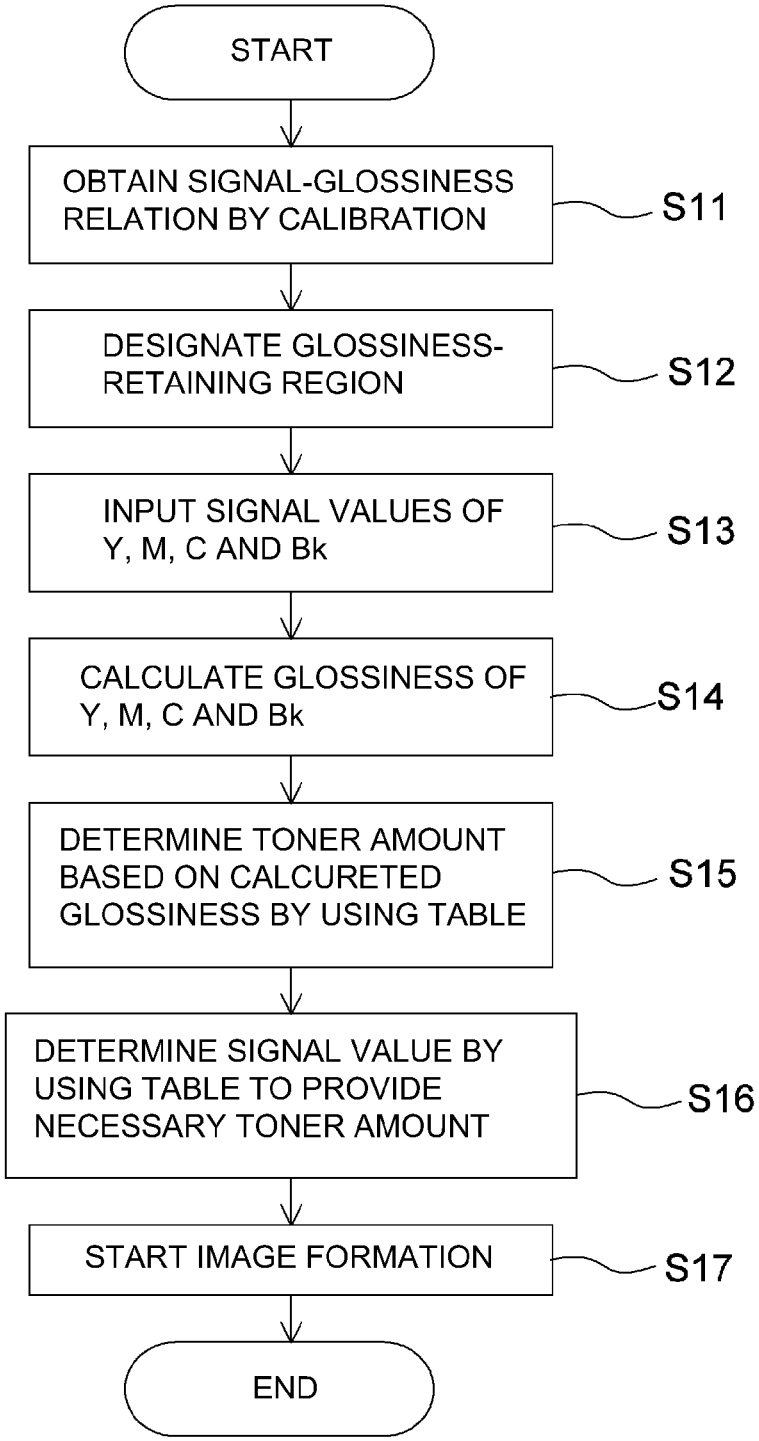
FIG. 10 is a flow chart of control in Second Embodiment.

The Second Embodiment will be described. With respect to the constitution similar to that in the First Embodiment described above, the description will be omitted. This embodiment is, different from First Embodiment in which the glossiness of the color toner corresponding to the image-signal value is determined by using the table, characterized in that the glossiness is accurately obtained by actually outputting an image for adjustment, which is called a calibration pattern, and by making reference to the relationship between the image-signal value and the glossiness. FIG. 10 is a flow chart of the control in the Second Embodiment.

Figure 11:
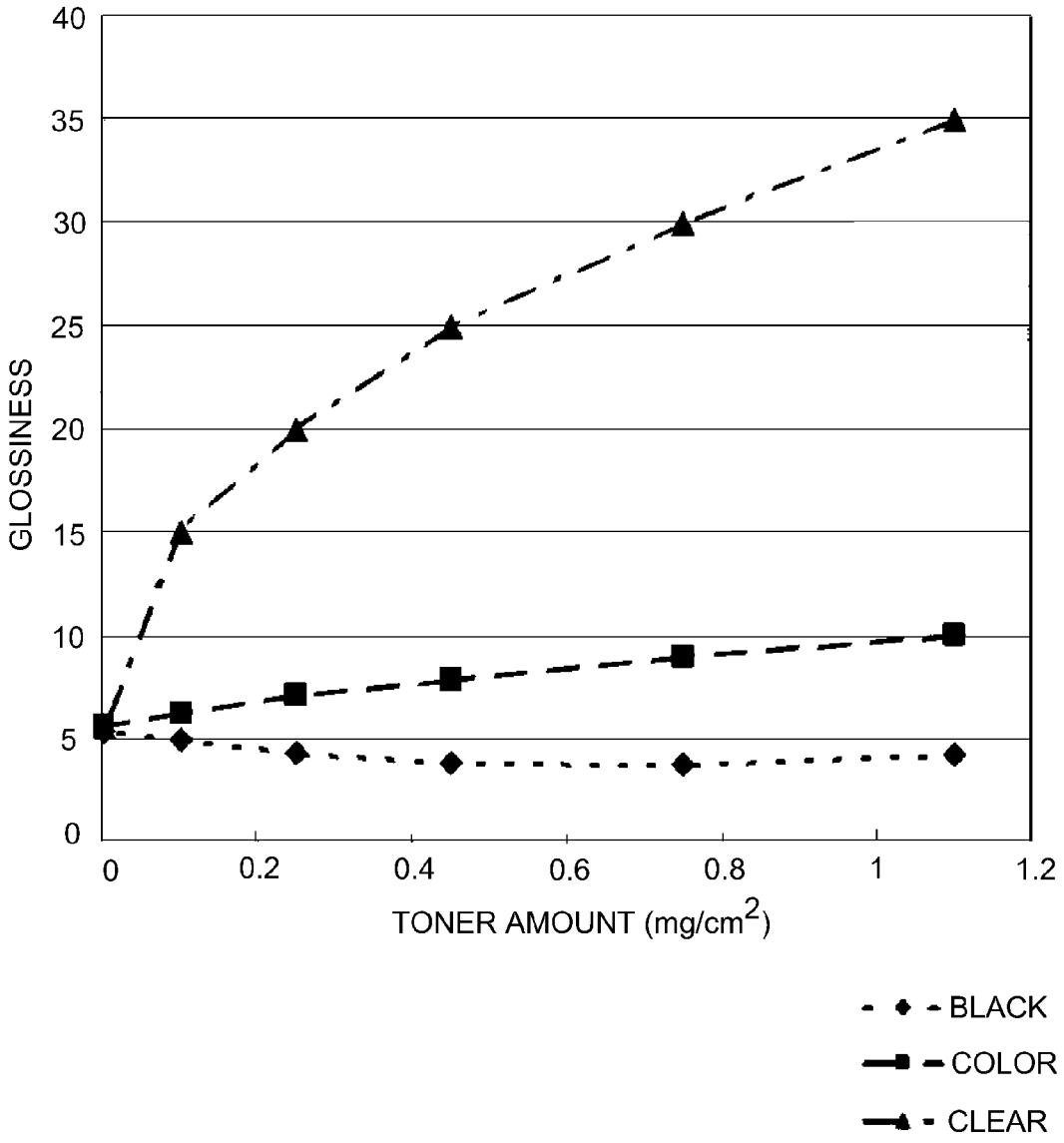
FIG. 11 is a graph for illustrating a relationship between the toner amount and the glossiness.

In this embodiment, a glossiness-measuring portion 122 (FIG. 1) for performing the measurement of the glossiness of the image for adjustment (the calibration pattern) to be outputted is provided. Further, the glossiness-control portion (transparent-toner-amount control means) 120 for controlling the transparent-toner amount on the basis of the measurement result of the glossiness-measuring portion 122 is provided. The glossiness of the image is determined by the transparent-toner amount (FIG. 11). FIG. 11 is a graph showing a relationship between the toner amount and the glossiness.

The control of the transparent-toner amount is effected so that the glossiness-difference feeling at the portion of the output image designated by the user is controlled to be the same, and in this embodiment, is effected for the purpose of making the glossiness-difference feeling of the image to be outputted substantially constant.

As shown in FIG. 11, in this embodiment, first, the calibration is performed by using the glossiness-measuring portion 122 (S11). Subsequent control is similar to that in the embodiment described above. Specifically, the region intended to retain the glossiness is designated by the user (S12) and when the image-signal values for the respective colors are inputted (S13), the glossiness of the image to be outputted is calculated (S14). Then, the transparent-toner amount is determined from the average glossiness (S15) and then the transparent toner image-signal value is determined (S16). As a result, the image formation can be started (S17). Next, a specific constitution will be described.

The glossiness of the image to be outputted also depends on an output sheet as the recording material P, i.e., a property of the recording material P and therefore the output sheet used for outputting the image intended to be subjected to glossiness control is set in a sheet feeding portion 51 (FIG. 1(*a*)) and then actuation of the glossiness-measuring portion 120 is started. When the glossiness-measuring portion 120 is actuated, by the above-described image forming process, the image for the glossiness control is outputted on the designated recording material. A pattern of the image for the glossiness control is a single-control, density-gradation pattern formed with a combination of each color (light color) toner and the transparent toner.

Figure 12:
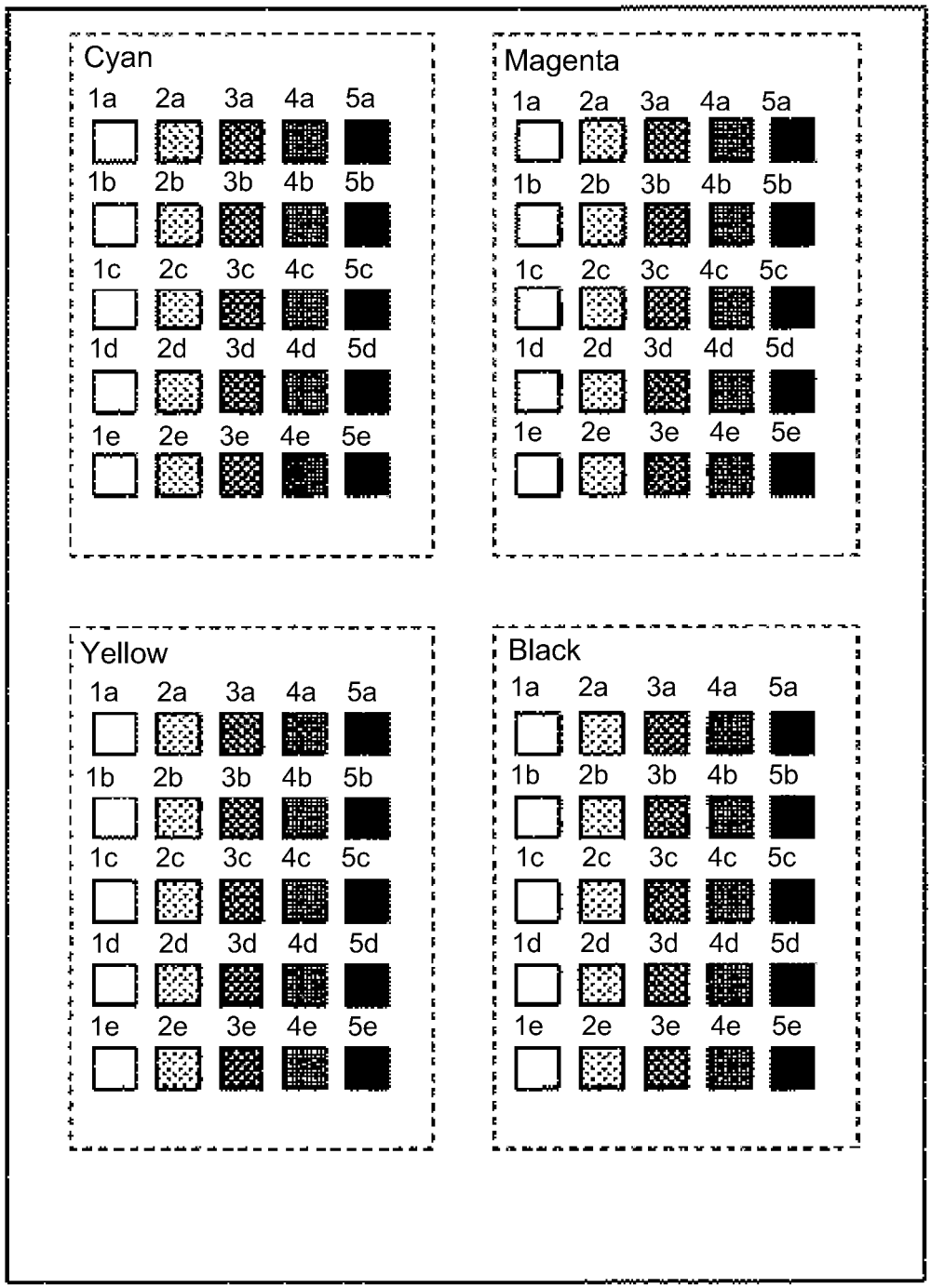
FIG. 12 is a schematic view showing a single-color, density-gradation pattern.

In this embodiment, the pattern shown in FIG. 12 was used. FIG. 12 is a schematic view showing the single-color, density-gradation pattern formed with the combination of each color (light color) toner and the transparent toner.

As for the image-output-control-signal level, the value for the maximum density of the image forming apparatus in this embodiment was set at 255 (level). Therefore, the image forming apparatus in this embodiment uses eight-bit gradation levels from 0 to 255 for each color toner (inclusive of transparent toner). Incidentally, in the preparation of the pattern shown in FIG. 12, the respective toner images of Y, M, C and Bk are formed by using the grid potential and the developing-bias potential determined by the above-described control method. Further, the grid potential and the developing-bias potential, which are used for preparing the transparent toner image, are determined in the following manner. That is, they are determined based on a relationship between the absolute water (moisture) content and the contrasts potential which are stored in advance in a table, and based on the output of the environment sensor 33. The grid potential and the developing-bias potential are determined by using the above-described potential-measurement control.

The pattern shown in FIG. 12 has four groups of density-gradation patterns, which correspond to four monochromatic primary colors, one for one, and each group has a combination of 25 density-gradation patterns different in density level (0, 64, 128, 192 and 255 levels)×5 (0, 64, 128, 192 and 255 levels). The upper left group in FIG. 12 is the density-gradation pattern for the cyan toner image, and the upper right group is the density-gradation pattern for the magenta toner image. The lower left group is the density-gradation pattern for the yellow toner image, and the lower right group is the density-gradation pattern for the black toner image.

That is, in each of the four groups of the density-gradation patterns, patterns 1*a*, 2*a*, 3*a*, 4*a* and 5*a* are formed of single-color toner alone (that is, cyan, magenta, yellow or black toner), and patterns 1*b*, 2*b*, 3*b*, 4*b* and 5*b* are realized by superposing the transparent toner in the amount equivalent to a density level of 64 on the patterns 1*a*, 2*a*, 3*a*, 4*a* and 5*a*, respectively. The patterns 1*c*, 2*c*, 3*c*, 4*c* and 5*c* are realized by superposing the transparent toner in the amount equivalent to a density level of 128 on the patterns 1*a*, 2*a*, 3*a*, 4*a* and 5*a*, respectively, and patterns 1*d*, 2*d*, 3*d*, 4*d* and 5*d* are realized by superposing the transparent toner in the amount equivalent to a density level of 192 on the patterns 1*a*, 2*a*, 3*a*, 4*a* and 5*a*, respectively. Further, patterns 1*e*, 2*e*, 3*e*, 4*e* and 5*e* are realized by superposing the transparent toner in the amount equivalent to a density level of 255 on the patterns 1*a*, 2*a*, 3*a*, 4*a* and 5*a*, respectively.

Incidentally, the patterns 1*a*, 1*b*, 1*c*, 1*d* and 1*e* are 0 mg/cm$^2$ in color-toner amount. That is, in the patterns 1*a*, 1*b*, 1*c*, 1*d* and 1*e*, the color-toner images are substantially not placed. The patterns 1*a*, 1*b*, 1*c*, 1*d* and 1*e* are formed of only the transparent toner.

The patterns 2*a*, 2*b*, 2*c*, 2*d* and 2*e* are 0.10 mg/cm$^2$ in color-toner amount. The patterns 3*a*, 3*b*, 3*c*, 3*d* and 3*e* are 0.25 mg/cm$^2$ in color-toner amount. The patterns 4*a*, 4*b*, 4*c*, 4*d* and 4*e* are 0.35 mg/cm$^2$ in color-toner amount. The patterns 5*a*, 5*b*, 5*c*, 5*d* and 5*e* are 0.50 mg/cm$^2$ in color-toner amount.

Further, the patterns 1*a*, 2*a*, 3*a*, 4*a* and 5*a* are 0 mg/cm$^2$ in transparent-toner amount. That is, in the patterns 1*a*, 2*a*, 3*a*, 4*a* and 5*a*, the transparent toner image is substantially not superposed. The patterns 2*a*, 3*a*, 4*a* and 5*d* are formed of only the color toner.

The patterns 1*b*, 2*b*, 3*b*, 4*b* and 5*b* are 0.10 mg/cm$^2$ in transparent-toner amount. The patterns 1*c*, 2*c*, 3*c*, 4*c* and 5*c* are 0.25 mg/cm$^2$ in transparent-toner amount. The patterns 1*d*, 2*d*, 3*d*, 4*d* and 5*d* are 0.35 mg/cm$^2$ in transparent-toner amount. The patterns 1*e*, 2*e*, 3*e*, 4*e* and 5*e* are 0.50 mg/cm$^2$ in transparent-toner amount.

In the pattern 1*a*, the transparent toner image and the color toner image are substantially not formed.

As described above, a set of the density-gradation patterns by the combination of the color toners and the transparent toner is constituted by the single-color, density-gradation patterns 1*a*-5*a* and the density-gradation patterns (1*b*-5*b*, 1*c*-5*c*, 1*d*-5*d* and 1*e*-5*e*) of the transparent toner superposed on density-gradation patterns corresponding to those (1*a*-5*a*). Thus, four sets (groups in total are prepared for the four color toners (i.e., cyan, magenta, yellow and black). At this time, the amount of transparent toner is adjusted so that the relationship between the amount of transparent toner and the transparent toner-output signal is linear.

A sample image which is the image formed by outputting the above-described four sets (groups) of the density-gradation patterns is placed on the original supporting platen glass 102 of the reader portion A, and its glossiness is measured. Incidentally, the glossiness-measuring portion may be provided as a part of the printer portion B or may be prepared as a separate portion from the image forming apparatus. Further, a series of operations from the output to the measurement may be performed manually or automatically. In the case where the glossiness-measuring portion is prepared separately from the image forming apparatus, a means for inputting detected glossiness level values into the image forming apparatus is necessary.

Figure 13:
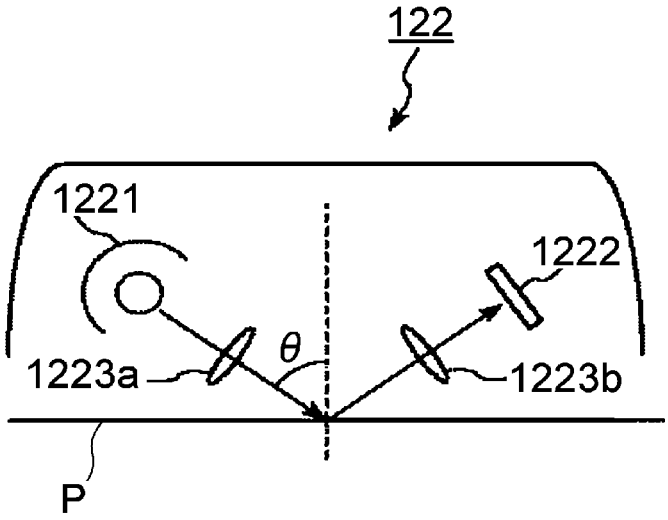
FIG. 13 is a schematic structural view of a glossiness-measuring portion.

Here, referring to FIG. 13, an embodiment of the glossiness-measuring portion 122 and the glossiness-measuring method used in this embodiment will be described. FIG. 13 is a schematic view showing a structure of the glossiness-measuring portion 122.

The glossiness-measuring portion 122 in this embodiment is configured to measure the glossiness by a method defined in JIS-Z8741. That is, in the measuring method, a flux of light, which is preset in angle of divergence, is projected upon the surface of the output image, at a preset angle of incidence (in accordance with JIS-Z8741), and a flux of the light reflected in a specular-reflection direction by the surface, which is preset in angle of divergence, is measured by a light receiving device.

Referring to FIG. 13, the flux of light projected from a light source 1221 transmits through a lens 1223*a*, and hits the recording material P at an angle of θ (angle of incidence). Then, a flux of the light reflected in the specular-reflection direction is detected by the light receiving device 1222 through a lens 1223*b*. This glossiness-measuring portion 122 is disposed at the reader portion A or the printer portion B to detect the surface glossiness of the output image. Incidentally, in this embodiment, the angle θ of incidence was set at 60 deg. to detect the surface glossiness.

Further, when the glossiness-measuring portion 122 is used to measure the glossiness of the pattern shown in FIG. 13, it is moved in a manner to oppose the pattern.

In this embodiment, the detection of the output image, i.e., the detection of the region in which the transparent toner image is superposed on the fixed color toner image includes, e.g., the following detection.

That is, the detection of a first region in which the inclined toward image is superposed on the fixed color toner image and the detection of a second region in which the transparent toner image is superposed on the color toner image that is formed in a toner amount per unit area different from that of the color toner image in the image region are included. In this case, the toner amount of the transparent toner image in the first region may also be different from that of the transparent toner image in the second region. It is also possible to detect a region in which substantially on color toner image is formed and only the transparent toner image is formed. On the basis of these detection results, the glossiness corresponding to the input image signal can be further accurately measured.

Data between the patterns (patches) are obtained by interpolation. In this embodiment, linear interpolation was performed but an optimum interpolation method may also be employed depending on characteristics of the image forming apparatus or the number of patterns (patches). In the manner as described above, from the respective image signals and the glossiness values measured at associated pixels, the image signal-glossiness table is prepared further accurately.

Further, a set value of the transparent toner-output signal obtained by the glossiness control by the glossiness-control portion 120 is stored in a storing means (memory) 121. A plurality of set values can be stored and it is possible to appropriately call up the necessary setting depending on a sheet used by the user.

Further, the glossiness control by the glossiness-control portion 120 can be effected, e.g., every predetermined number of sheets, such as every number of image formation sheets that is arbitrarily settable between 1000 sheets and 5000 sheets, or every predetermined time, such as every elapsed time that is arbitrarily settable between 1 month and 2 months.

It is possible to variably control the toner amount per unit area of the transparent toner (image) on the recording material P with high accuracy. By making reference to the average glossiness-transparent-toner-amount table as shown in FIG. 9 in the First Embodiment described above, the average glossiness is obtained on the output image surface, so that the transparent-toner amount is determined.

Third Embodiment

The Third Embodiment will be described. A constitution similar to that in the embodiment described above will be omitted from the description. In the embodiment described above, a comparison object for realizing the same glossiness-difference feeling was the region in which the average glossiness of the output image is obtained and the transparent toner is added but in this embodiment, the average glossiness in the entire output image region is not obtained. This embodiment is characterized by designating a region in which the average glossiness is obtained.

As a result, the glossiness-difference feeling can be made the same not only in the entire output image, but also between desired portions designated by the user. Further, the feature of this embodiment is that two portions are designated as the region in which the user intends to keep the glossiness difference. That is, in the embodiment, only the region in which the transparent toner image is formed is designated. On the other hand, in this embodiment, in addition to the region in which the transparent toner image is formed, its comparison object region is also designated.

Figure 14:
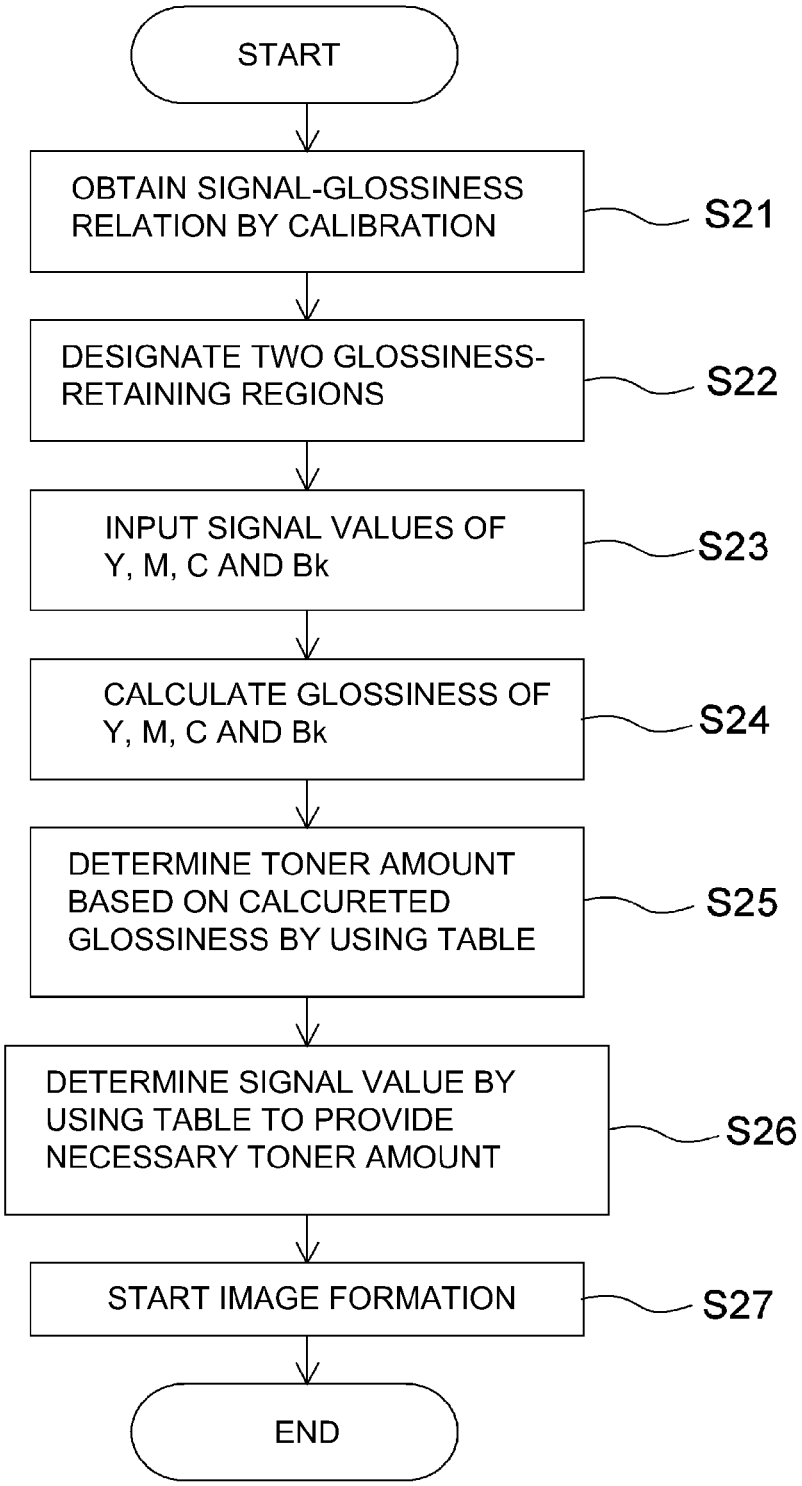
FIG. 14 is a flow chart of control in Third Embodiment.

The steps in this embodiment are shown in FIG. 14. FIG. 14 is a flow chart of control in the Third Embodiment. As shown in FIG. 14, after calibration is performed (S21), two portions are designated as the region in which the glossiness difference is intended to be retained (S22). Thereafter, when the image-signal values for the respective colors are inputted (S23), the glossiness of the image to be outputted is calculated (S24). Then, the transparent-toner amount is determined from the average glossiness (S25) and then the transparent toner image-signal value is determined (S26). As a result, the image formation can be started (S27).

As a result, it is possible to obviate a possibility that the average glossiness is estimated as a low value due to an image print ratio. The case where the average glossiness is estimated as the low value occurs, e.g., when image print is made at an extremely localized portion. This is because the average glossiness in the entire image is lower than that in the region in which the image print is made in the case where the image is printed (formed) in a certain region which is ⅓ of the output image and the region intended to be made conspicuous is present in the certain region.

In this embodiment, e.g., the output image and the region in which the transparent toner is added are displayed on a screen and then the average glossiness is obtained from the image-signal value inputted into the pixel in the region designated by the user.

Fourth Embodiment

This embodiment is characterized in that a degree of the glossiness-difference feeling can be determined. In the embodiments described above, the added amount of the transparent toner for obtaining the same glossiness is changed by the base glossiness. On the other hand, in this embodiment, in the control by the glossiness-control portion 120, the following two modes:

Glossiness-difference feeling: large,

Glossiness-difference feeling: medium, are provided, so that the degree of the glossiness-difference feeling is controlled. As a result, the fixed degree of the glossiness-difference feeling can be changed.

Figure 15:
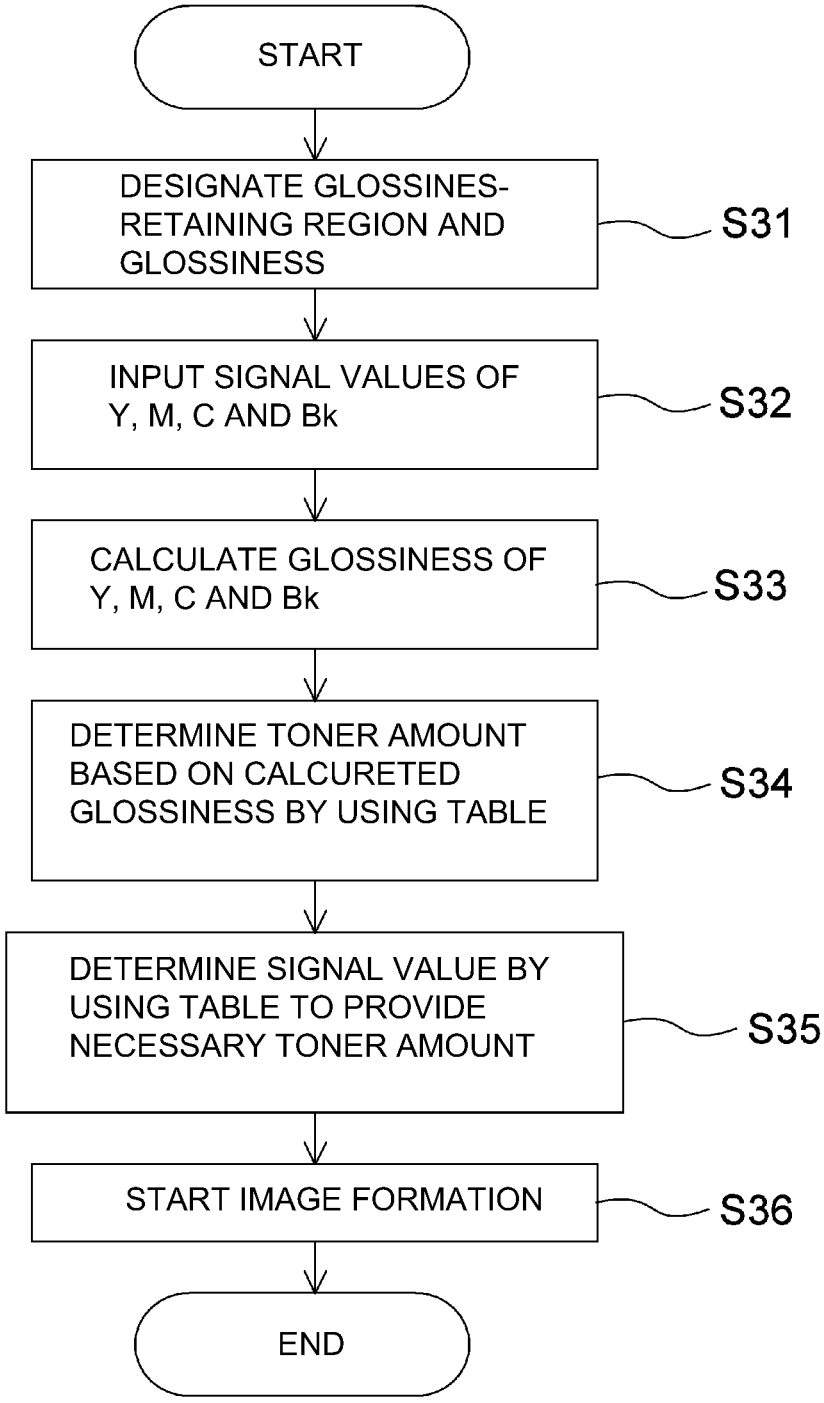
FIG. 15 is a flow chart of control in Fourth Embodiment.

The steps in this embodiment are shown in FIG. 15. FIG. 15 is a flow chart of control in the Fourth Embodiment. In this embodiment, first, the region in which the glossiness difference is intended to be retained and the degree of the glossiness difference (e.g., large or medium) are designated by the user (S31). Subsequent control is similar to that in the embodiment described above. Specifically, when the image-signal values for the respective colors are inputted (S32), the glossiness of the image to be outputted is calculated and determined (S33). Then, the transparent-toner amount is determined from the average glossiness (S34) and then the transparent toner image-signal value is determined (S35). As a result, the image formation can be started (S36). Next, a specific constitution will be described.

Figure 16:
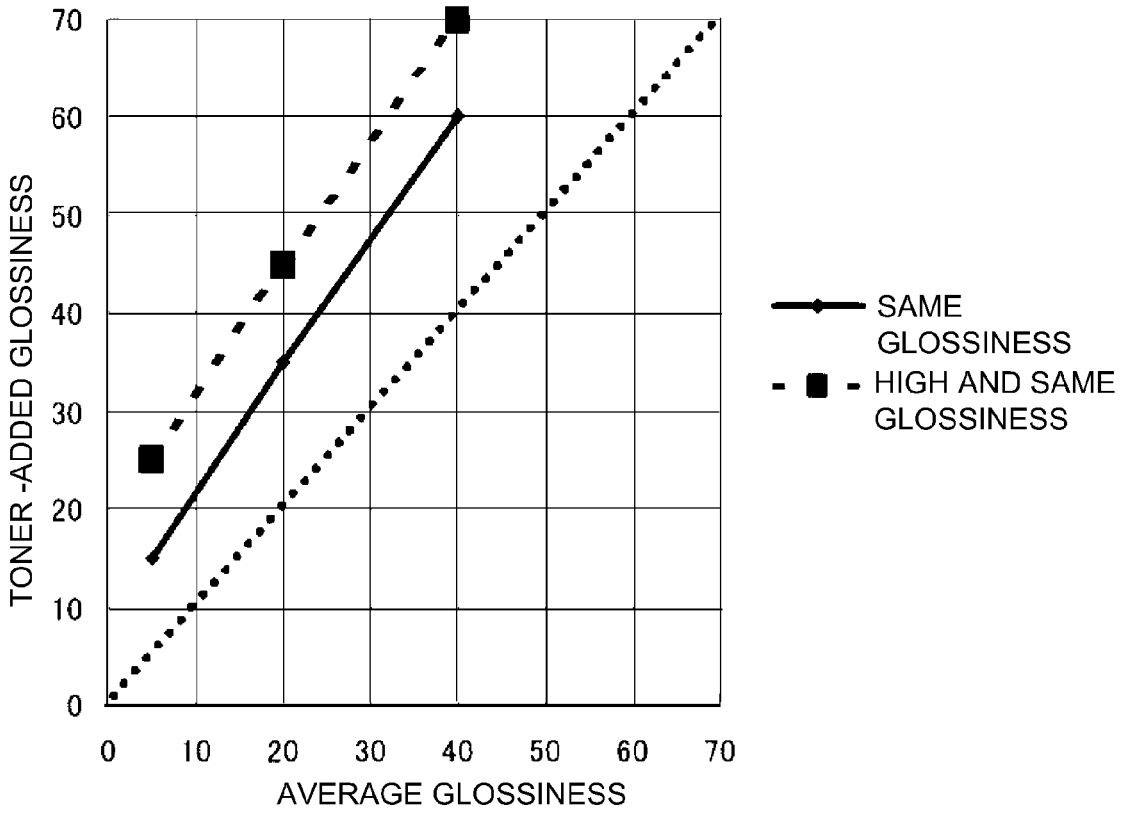
FIG. 16 is a graph showing a subjective evaluation result of glossiness that is felt as being the same (and high).
Figure 17:
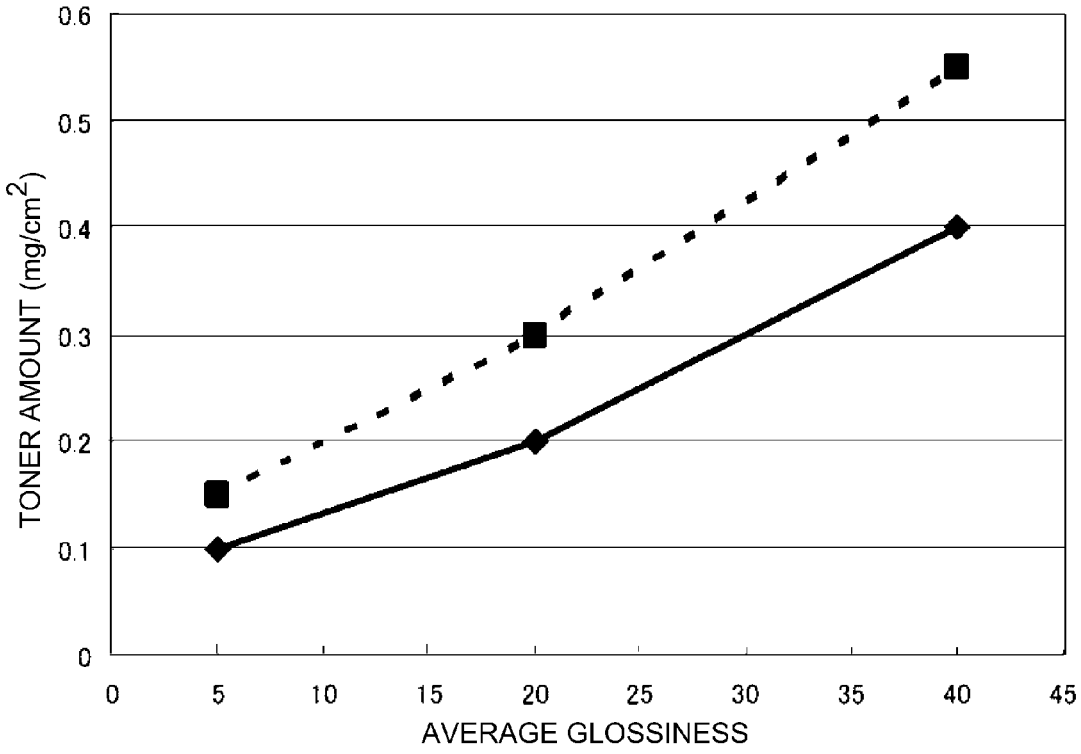
FIG. 17 is a graph showing a relationship between an average glossiness and an added transparent-toner amount.

FIG. 16 is a graph showing a subjective evaluation result of glossiness felt as being the same glossiness difference. Referring to FIG. 16, in order to retain a certain glossiness-difference feeling while a large glossiness difference is felt by the user, a plurality of tables showing the relationship between the added amount of the transparent toner and the average glossiness may be prepared. That is, as shown in FIG. 17, two tables may be provided. FIG. 17 is a graph showing the two tables each showing the relationship between the added amount of the transparent toner and the average glossiness.

Figure 18:
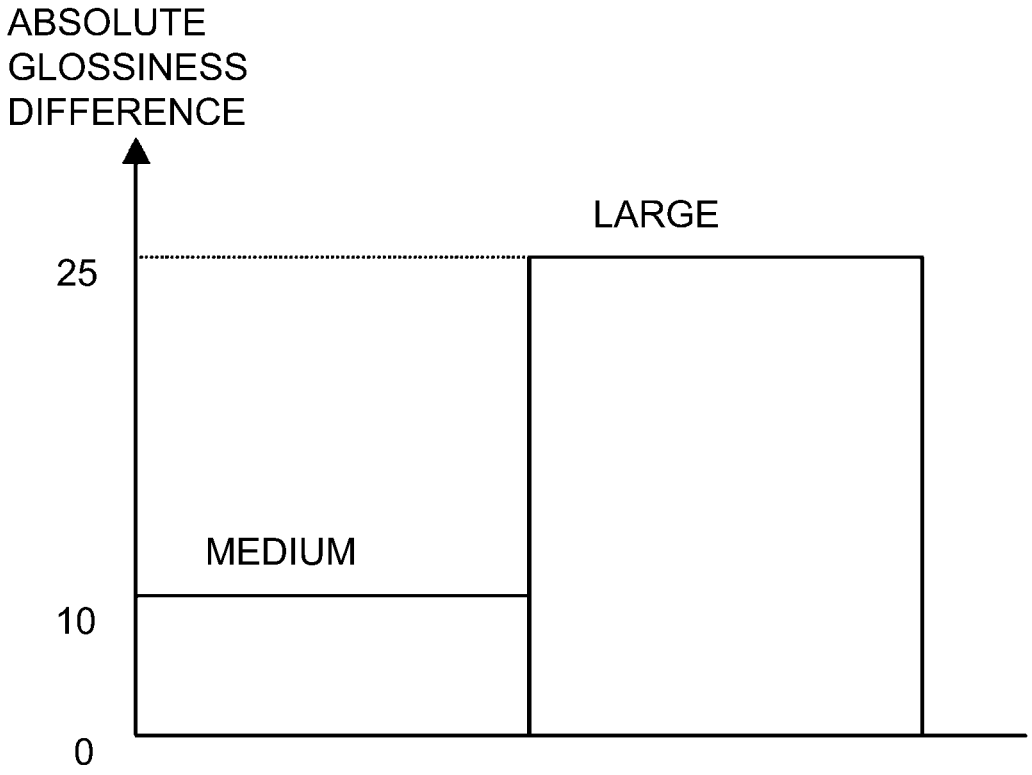
FIG. 18 is a graph showing a relationship between a glossiness-difference feeling and an absolute glossiness difference.

A step of the glossiness is as shown in FIG. 18. FIG. 18 is a graph showing the relationship between the glossiness-difference feeling and the absolute glossiness difference.

In the case where the large degree of the glossiness-difference feeling is selected, the transparent-toner amount along a dotted line indicated in the figure may be determined. In the case of the medium degree of the glossiness-difference feeling, the absolute glossiness difference is 10, and in the case of the large degree of the glossiness-difference feeling, the absolute glossiness difference is 25. A step width of the glossiness difference is not the same between the medium degree and the large degree. The glossiness difference in the step from the medium glossiness difference to the large glossiness difference is largely changed compared with the step from no glossiness difference to the medium glossiness difference.

As described above, the user can select the degree (large or medium) of the glossiness-difference feeling, so that it becomes possible to change the manner in which the glossiness-difference feeling is received (felt) by the user. Incidentally, the number of modes (degrees) of the glossiness difference (feeling) is not limited to two as in this embodiment but may also be three or more.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 075437/2010 filed Mar. 29, 2010, which is hereby incorporated by reference.

What is claimed is:

1. An image forming apparatus comprising:

an image forming portion configured to (i) form a color toner image on a recording material using color toner and (ii) form a transparent toner image on the recording material using transparent toner to partly and relatively increase the glossiness of the color toner image;

a fixing portion configured to fix the color toner image and the transparent toner image to the recording material; and a controlling portion configured to control a toner amount per unit area of the transparent toner image to be formed on the recording material on the basis of a toner amount per unit area of the color toner image to be formed in an adjacent region adjacent to a region in which the transparent toner image is to be formed, wherein said controlling portion sets the toner amount per unit area of the transparent toner image to a first value when the toner amount per unit area of the color toner image in the adjacent region is smaller than a predetermined value, and sets the toner amount per unit area of the transparent toner image to a second value which is larger than the first value when the toner amount per unit area of the color toner image in the adjacent region is larger than the predetermined value.

2. An image forming apparatus according to claim 1, further comprising a detector configured to detect the type of the recording material on which the color toner image and the transparent toner image are to be formed, wherein said controlling portion controls the toner amount per unit area of the transparent toner image to be formed on the recording material on the basis of the type of the recording material detected by said detector.

3. An image forming apparatus according to claim 1, wherein said image forming portion forms a yellow toner image, a cyan toner image, a magenta toner image and a black toner image, as the color toner image, on the recording material.

4. An image forming apparatus comprising:

an image forming portion configured to (i) form a color toner image on a recording material using color toner and (ii) form a transparent toner image on the recording material using transparent toner to partly and relatively increase the glossiness of the color toner image;

a fixing portion configured to fix the color toner image and the transparent toner image to the recording material; and a controlling portion configured to control a toner amount per unit area of the transparent toner image to be formed on the recording material on the basis of a calculated glossiness of the color toner image to be formed in an adjacent region adjacent to a region in which the transparent toner image is to be formed, wherein said controlling portion sets the toner amount per unit area of the transparent toner image to a first value when the calculated glossiness of the color toner image in the adjacent region is lower than a predetermined level, and sets the toner amount per unit area of the transparent toner image to a second value which is larger than the first value when the calculated glossiness of the color toner image in the adjacent region is higher than the predetermined level.

5. An image forming apparatus according to claim 4, further comprising a detector configured to detect the type of the recording material on which the color toner image and the transparent toner image to be formed, wherein said controlling portion controls the toner amount per unit area of the transparent toner image to be formed on the recording material on the basis of the type of the recording material detected by said detector.

6. An image forming apparatus according to claim 4, wherein said image forming portion forms a yellow toner image, a cyan toner image, a magenta toner image and a black toner image, as the color toner image, on the recording material.

7. An image forming apparatus comprising:

an image forming portion configured to (i) form a color toner image on a recording material using color toner and (ii) form a transparent toner image on the recording material using transparent toner to partly and relatively increase the glossiness of the color toner image in a first region and a second region;

a fixing portion configured to fix the color toner image and the transparent toner image to the recording material; and a controlling portion configured to control a toner amount per unit area of the transparent toner image to be formed on the recording material in the first region and the second region so that the glossiness difference perceived by human eyes between the first region and a first adjacent region adjacent to the first region and the glossiness difference perceived by human eyes between the second region and a second adjacent region adjacent to the second region are substantially the same, irrespective of a toner amount per unit area of the color toner image to be formed in each of the first adjacent region and the second adjacent region.

8. An image forming apparatus according to claim 7, wherein said image forming portion forms a yellow toner image, a cyan toner image, a magenta toner image and a black toner image, as the color toner image, on the recording material.

* * * * *